US007155941B2

(12) United States Patent
Sonomura

(10) Patent No.: US 7,155,941 B2
(45) Date of Patent: Jan. 2, 2007

(54) KNITTING MACHINE HAVING VARIABLE RATE-CHANGING MECHANISM

(75) Inventor: Minoru Sonomura, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 64 days.

(21) Appl. No.: 10/523,648

(22) PCT Filed: Jul. 31, 2003

(86) PCT No.: PCT/JP03/09776

§ 371 (c)(1),
(2), (4) Date: Feb. 4, 2005

(87) PCT Pub. No.: WO2004/016842

PCT Pub. Date: Feb. 26, 2004

(65) Prior Publication Data

US 2005/0268666 A1 Dec. 8, 2005

(30) Foreign Application Priority Data

Aug. 6, 2002 (JP) ..... 2002-228651

(51) Int. Cl.
*D04B 15/36* (2006.01)

(52) U.S. Cl. ..... 66/78

(58) Field of Classification Search ..... 66/78, 66/71, 74

See application file for complete search history.

(56) References Cited

U.S. PATENT DOCUMENTS 4,510,775 A 4/1985 Shima
4,554,802 A * 11/1985 Goller et al. ..... 66/71
4,686,839 A * 8/1987 Schmid ..... 66/75.2
4,723,423 A * 2/1988 Goller et al. ..... 66/71
5,251,462 A 10/1993 Shima
5,255,538 A * 10/1993 Day et al. ..... 66/71

FOREIGN PATENT DOCUMENTS

EP 698679 B1 3/1999
JP 2929041 B2 5/1999

* cited by examiner

*Primary Examiner*—Danny Worrell
(74) *Attorney, Agent, or Firm*—Rothwell, Figg, Ernst & Manbeck

(57) ABSTRACT

There are provided a stitch cam including a first cam in which a stitch size determining cam surface for a large-sized stitch and a receiving cam surface are formed in the same phase, and a second cam which has a common retracting cam surface and in which a receiving cam surface is formed in the same phase as a stitch size determining cam surface for the small-sized stitch, and drive mechanism for the first cam and the second cam, wherein the second cam is supported on the first cam in such a manner that when the first cam is shifted in the front-and-back direction by the drive mechanism of the first cam, the second cam is shifted together in the front-and-back direction and also shifted relative thereto in the front-and-back direction by the drive mechanism of the second cam so that the stitch size determining cam surface provided in the second cam can be displaced with respect to the stitch size determining cam surface provided in the first cam, whereby a small-sized stitch and a large-sized stitch are formed in the same course.

5 Claims, 9 Drawing Sheets

Fig. 4
Fig4A
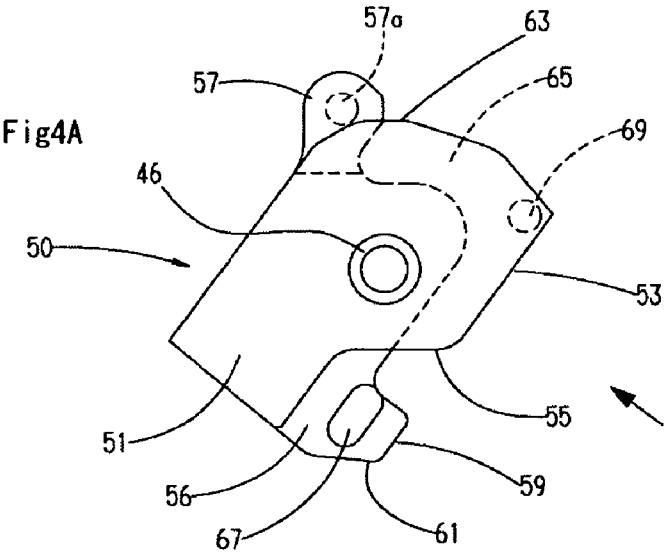
Fig4B
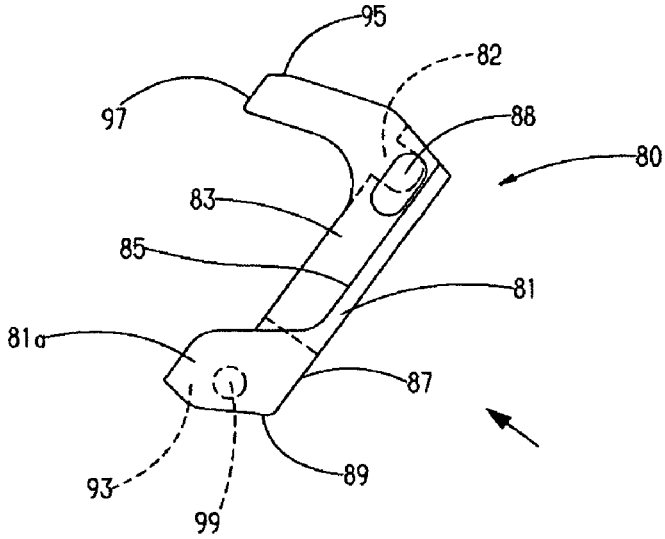
Fig4C
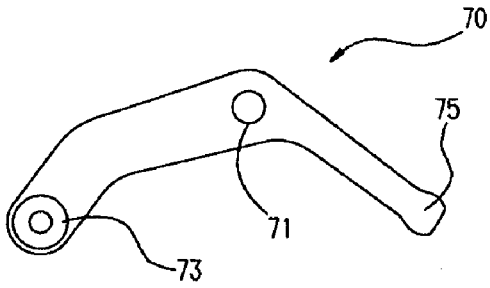

Fig. 5
Fig5A
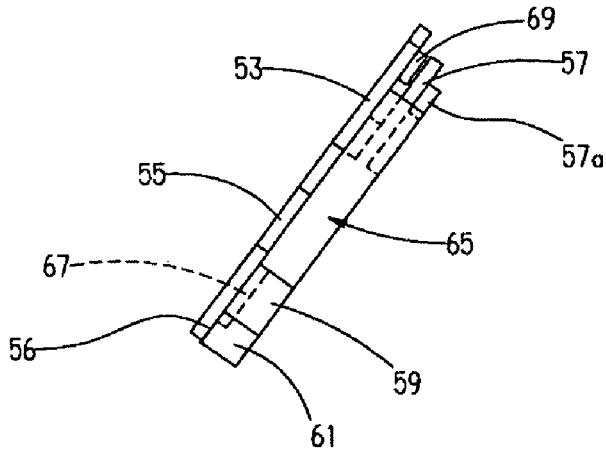
Fig5B
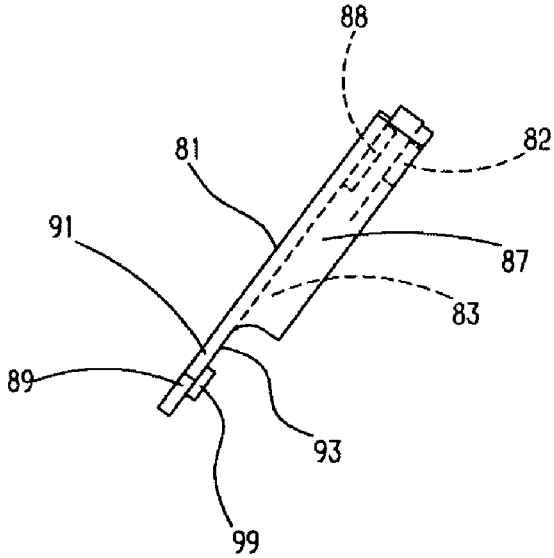

Fig. 7
Fig7A
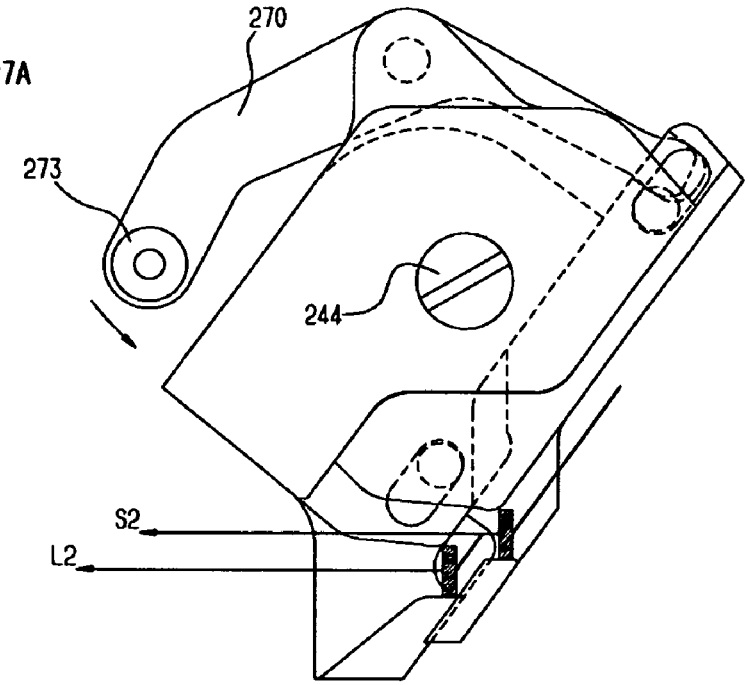
Fig7B
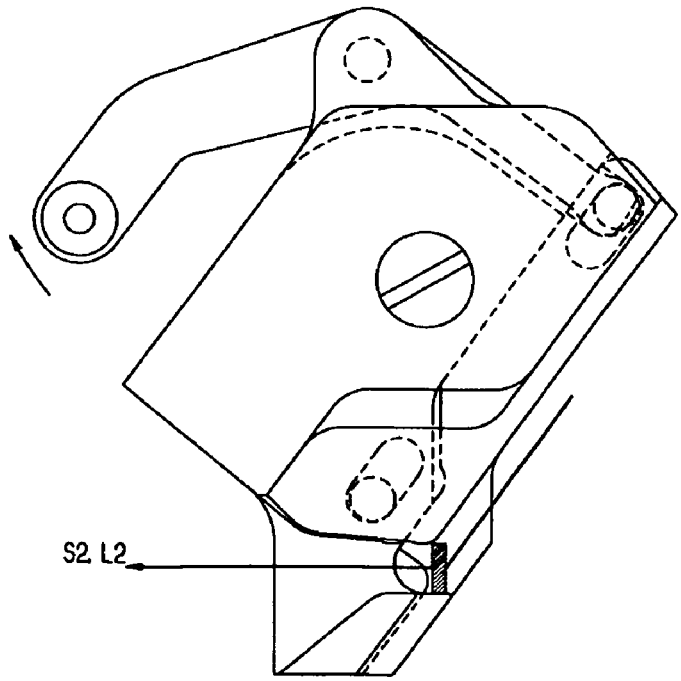

Fig. 8
Fig8A
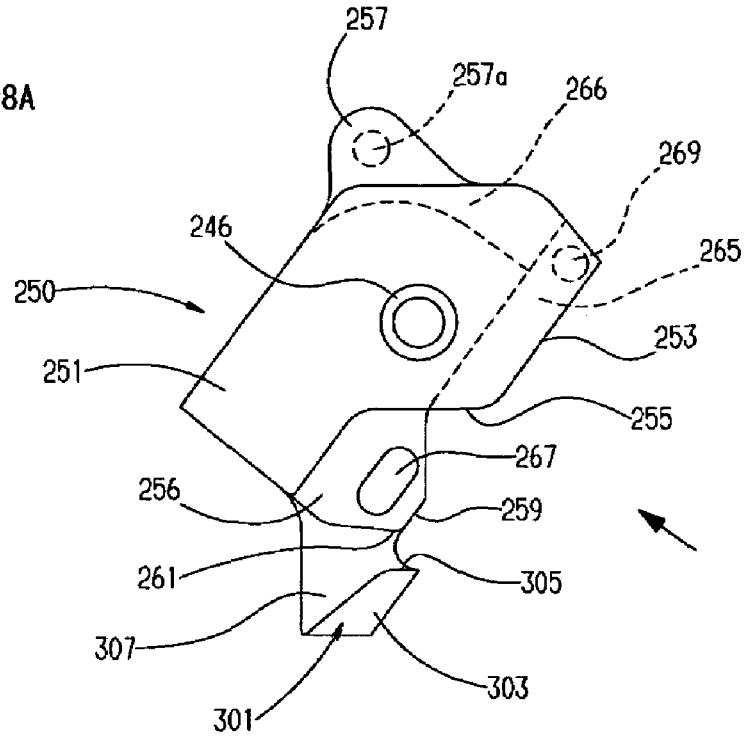
Fig8B
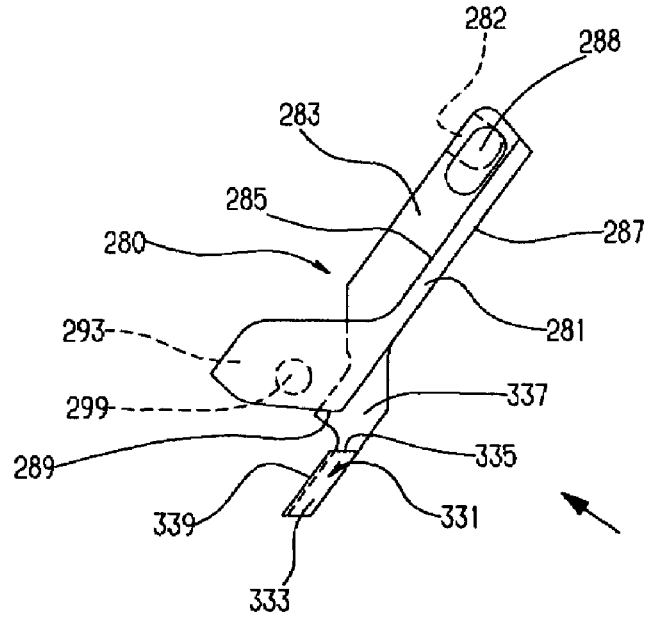

Fig. 9
Fig9A
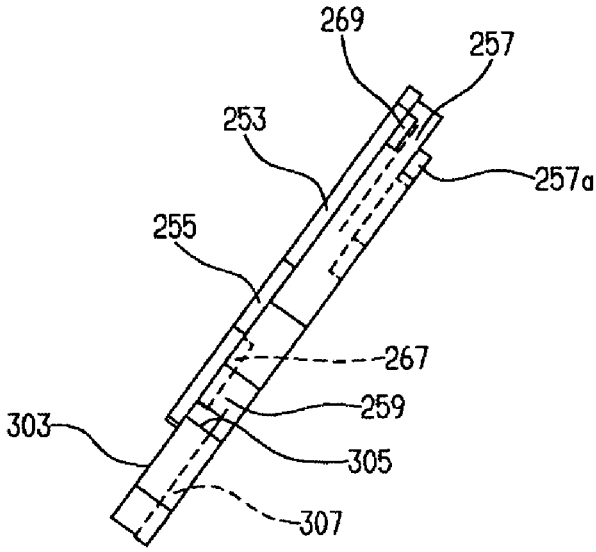
Fig9B
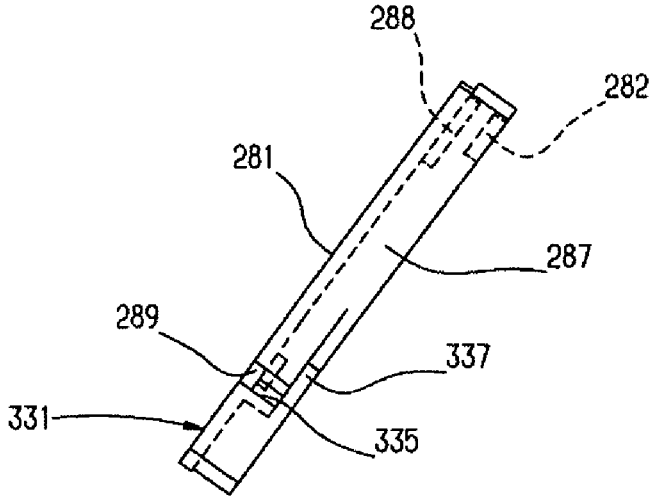

KNITTING MACHINE HAVING VARIABLE RATE-CHANGING MECHANISM

CROSS REFERENCE TO RELATED APPLICATION

This application is a 35 USC §371 National Phase Entry Application from PCT/JP2003/009776, filed Jul. 31, 2003, and designating the United States.

TECHNICAL FIELD

The present invention relates to a flat knitting machine that can form stitches of different sizes in the same knitting course and, more particularly, to a knitting machine having a variable stitch mechanism that can adjustably vary proportions of sizes of the stitches formed.

BACKGROUND ART

In the specification, expressions such as full, half and zero heights are used in expressing heights of cams and pressers and states of butts. In relation to a butt, full height indicates a state when the butt is not subjected to a pressing action of a presser, half height indicates a state when the butt is pressed to be generally half sunken by a second stitch presser, and zero height indicates a state when the butt is subjected to the pressing action of the presser of full height. In relation to the cam and the presser, As the cam and the presser are moved closer to a needle bed, the cam surface is expressed as being increasing in height. The cam of full height is engageable with the butt of half height as well as the butt of full height. The cam of half height is only engageable with the butt of full height. The cam of zero height can allow passage of the butt of full height. A front side of a carriage with respect to a traveling direction thereof is expressed as "the leading side" and a rear side of the same is expressed as "the trailing side". As to a traveling direction of a needle, a direction in which needles are moved forward to the needle bed gap is expressed as "the front side" and the opposite direction is expressed as "the rear side". Parts of the stitch cam are also expressed in the same manner: a part of the stitch cam closer to the needle bed gap is expressed as "the front side" and a part of the same far away therefrom is expressed as "the rear side". In addition, the term, a vertical height, used herein is intended to mean a height with respect to a direction orthogonal to a drawing (a plane of paper).

In general, the stitch cam, which is called a second stitch cam, is used to form different-sized stitches in a course formed at a single traverse of the carriage. The stitch cam has a first stitch size determining cam surface engageable with a butt which is held at the level of the full height without being subjected to a pressing action of a presser (which is hereinafter referred to as "butt of full height") and a second stitch size determining cam surface only engageable with the butt which is pressed and located at the level of the half height by a second stitch presser of half height (which is hereinafter referred to as "butt of half height"). The second stitch size determining cam surface engageable with the butt of half height is formed in front of the first stitch size determining cam surface engageable with the butt of full height. Due to this, the stitch formed with the needle of the butt of full height is pulled in excessively by the extent corresponding to the step difference between the cam surfaces and thus is increased in size, as compared with the stitch formed with the needle of the butt of half height.

Meanwhile, since a force generated when the needle is retracted increases in proportion to a knitting speed, the butt may undesirably be retracted further beyond the stitch size determining cam surface of the stitch cam. In this case, the stitch cannot be formed at a predetermined stitch size, causing a negative effect on the knitting of a knitted fabric. When the butt is retracted variably, the stitch formed with the needle of the butt of full height and the stitch formed with the needle of the butt of half height may be made indistinguishable from each other or may be reversed in size under certain circumstances.

The applicant of this application for patent previously made a proposal for the stitch cam, as described in JP Laid-open (Unexamined) Patent Publication No. Hei 8-60499 (European Patent Specification No. EP 0698679). The publication discloses the stitch cam wherein a stitch size determining cam surface for the butt of half height and a stitch size determining cam surface for the butt of half height are arranged to be shifted in phase on a common lowering cam surface for lowering both of the butt of half height of the needle and the butt of full height of the needle, so that the former is located at the leading side of the common lowering cam surface and the latter is located at the trailing side thereof, and receiving cams for restricting lowering positions of the butts are arranged in the phase common to that of the stitch size determining cam surfaces so as to correspond in position to them. This stitch cam can solve the problems described above, but, since the stitch cam is designed so that the stitch size determining cam surfaces for the butt of half height and the butt of full height and the receiving cams corresponding to those stitch size determining cam surfaces are all arranged on the single cam, the step difference between the stitch size determining cam surfaces is fixed invariably.

On the other hand, a stitch size adjustable cam is also known, though not shown, which is designed to adjustably vary the step difference between the stitch size determining cam surface for the butt of full height and the stitch size determining cam surface for the butt of half height, so as to adjust proportions of sizes of the stitches formed. Flat knitting machines having this function include, for example, computer-assisted flat knitting machines (e.g. SET-092FF, SIK-102KI (product name)) manufactured by Shima Seiki Mfg., Ltd. These flat knitting machines are designed so that a movable cam having the stitch size determining cam surface for the butt of full height is pivotally mounted on the stitch cam which can act on the butt of full height and the butt of half height and a manual adjusting dial is arranged at the outside of the carriage, so that the movable cam can be changed in position to adjust the stitch step difference by turning the adjusting dial. This flat knitting machine can allow the adjustment of the stitch step difference between the stitch size determining cam surfaces, but, since the stitch cam is not provided with any receiving cam to restrict the lowering positions of the butts, the butts can be retracted excessively beyond the stitch size determining cam surfaces. Further, since the adjustment of the stitch step difference between the stitch size determining cam surface of the movable cam and that of the stitch cam is allowed by changing the position of the movable cam, the orientation of the stitch size determining cam surface of the movable cam adjusted to the position makes a small angle with the orientation of the stitch size determining cam surface of the stitch cam. It is desirable for stitch formation to make the orientation of the stitch size determining cam surface invariable, independently of the stitch step difference, but the second stitch cam of the type designed to allow the adjustment of the stitch step difference by changing the rock position as described above cannot avoid this problem.

It is an object of the present invention to provide a knitting machine having a variable stitch mechanism that can prevent the needles of different height butts being retracted excessively beyond the stitch size determining cam surfaces, while allowing variable adjustment of the stitch step difference between the stitch size determining cam surfaces.

DISCLOSURE OF THE INVENTION

The present invention provides 1. A knitting machine having a variable stitch mechanism comprising a stitch cam for second stitch comprising a common retracting cam surface to engage with at least one of butts projecting from a needle bed and set at different levels of full height and half height under a pressing action of a presser arranged in a carriage, so as to retract both a butt of half height of a small stitch forming needle and a butt of full height of a large stitch forming needle, a stitch size determining cam surface for a small-sized stitch which is formed to extend continuously from the common retracting cam surface, a stitch size determining cam surface for a large-sized stitch which is engageable with the butt of full height formed at a trailing side with respect to the stitch size determining cam surface for the small-sized stitch, and a receiving cam to restrict excessive retraction of each of the butts of the different-sized stitches forming needles beyond the stitch size determining cam surface corresponding to the butt of the stitch forming needle, whereby the small-sized stitch and the large-sized stitch are formed in the same course, wherein there are provided the stitch cam comprising:

a first cam in which a stitch size determining cam surface for a large-sized stitch and a receiving cam surface to engage with a butt of the needle for forming the large-sized stitch are formed in the same phase as the stitch size determining cam surface, and a second cam having a common retracting cam surface and a stitch size determining cam surface for a small-sized stitch extending continuously from the common retracting cam surface, wherein a receiving cam surface engageable with a butt of the needle for forming the small-sized stitch is formed in the same phase as the stitch size determining cam surface for the small-sized stitch, drive means for driving the first cam in a front-and-back direction, and drive means for driving the second cam in the front-and-back direction, and wherein the second cam is supported on the first cam in such a manner that when the first cam is shifted in the front-and-back direction by the drive means of the first cam, the second cam is shifted together in the front-and-back direction and also shifted relative thereto in the front-and-back direction by the drive means of the second cam so that the stitch size determining cam surface provided in the second cam can be displaced with respect to the stitch size determining cam surface provided in the first cam.

In the knitting machine, a linkage is pivotally mounted on the first cam and linked at one end thereof to the drive side and at the other end to the second cam, so that when the linkage is rotated by the drive of the drive means of the second cam, the second cam is driven to adjust a position of the stitch size determining cam surface of the second cam relative to the stitch size determining cam surface of the first cam.

In the knitting machine, a drive guide cam which is driven in the front-and-back direction or a left-and-right direction by the drive means of the second cam is arranged between the drive means of the second cam and the linkage, a drive guide extending in parallel with a sliding direction of the stitch cam is formed in the drive guide cam, and a driving side of the linkage is supported to freely move along the drive guide.

In the knitting machine, the receiving cam surfaces are formed at front sides of the first and second cams and in the same phase as the respective stitch size determining cam surfaces, and wherein another butt, which is engageable with these receiving cams and is arranged so that a distance between the butt and the another butt can be equal to a distance between the stitch size determining cam surfaces and the receiving cam surfaces, is formed in the needle.

In the knitting machine, the receiving cam surfaces are arranged at the rear side of the first and second cams to confront the stitch size determining cam surfaces across path regions of the butts.

According to the present invention, the stitch cam is formed by at least two separate parts, namely, the first cam and the second cam. The second cam has the common retracting cam for the large-sized and small-sized stitches, the stitch size determining cam surface for the small-sized stitch extending continuously therefrom, and the receiving cam corresponding thereto. On the other hand, the first cam has the stitch size determining cam surface for the large-sized stitch and the receiving cam corresponding thereto. The first cam and the second cam are driven in the front-and-back direction by their respective drive means for driving the first and second cams. The second cam is mounted on the carriage in the state of being supported on the first cam, so that when the first cam is driven by the drive means of the first cam, the second cam is also driven in the front-and-back direction by the extent equal to the distance the first cam is driven. Further, since the second cam mounts thereon the drive means for driving only the second cam back and forth, the second cam supported on the first cam can be shifted relative to the first cam and thereby the stitch size determining cam surface formed in the second cam can be shifted relative to the stitch size determining cam surface of the first cam, to adjust the step difference therebetween.

Once a certain step difference is set between the first cam and the second cam by driving the drive means of the second cam, for example, the knitted fabric can be knitted in the state of the set step difference being kept unchanged. This means that a proportion between a large-sized stitch and a small-sized stitch is determined by this step difference. For example, when a knitted fabric is knitted using the stitch size determining cam surface for forming the large-sized stitch as a reference of the knitting of the knitting fabric, the stitch formed via the stitch size determining cam surface for forming the small-sized stitch is decreased in size to the extent corresponding to this step difference. The second cam is driven together with the first cam when driven by the drive of the drive means of the first cam. Hence, even when the first cam is voluntarily driven in a certain course in the middle of knitting the knitted fabric, since the second cam is also driven to the extent equal thereto simultaneously, the step difference set between the first cam and the second cam can be kept constant invariably.

In the arrangement wherein the receiving cams are arranged at the front sides of the first and second cams, when for example the second butt provided at the rear side, out of the first and second needle operating butts, is retracted to the stitch size determining cam surface to form the stitch, the first butt provided at the front side is brought into engagement with the receiving cam surface. Hence, the second butt can be prevented from being retracted excessively.

Also, in the arrangement wherein the receiving cam surfaces are arranged at the rear sides of the first and second cams to confront the stitch size determining cam surfaces across path regions of the butts, the retracting cam, the stitch size determining cam, and the receiving cam can all be allowed to act on the same butt. Hence, this arrangement can allow the application to the needle having only a single butt as the retractable needle operation means.

BRIEF DESCRIPTION OF THE DRAWINGS

FIG. 3A illustrates the state in which a step difference of a second stitch is set to be large and FIG. 3B illustrates the state in which the step difference of the second stitch is set to be zero.

FIG. 4 is a view showing main components of a stitch cam for the second stitch.

FIG. 5 shows side elevation views of the components as viewed from the directions indicated by arrows of FIG. 4.

FIG. 6A illustrates the state in which a step difference of the second stitch is set to be large and FIG. 6B illustrates the state in which the step difference of the second stitch is set to be zero.

FIG. 7 shows a stitch cam according to the third embodiment.

FIG. 7A illustrates the state in which a step difference of the second stitch is set to be large and FIG. 7B illustrates the state in which the step difference of the second stitch is set to be zero.

FIG. 8 shows a first cam and a second cam of the stitch cam according to the third embodiment.

FIG. 9 shows side elevation views of the components as viewed from the directions indicated by arrows of FIG. 8.

BEST MODE FOR CARRYING OUT THE INVENTION

Figure 1:
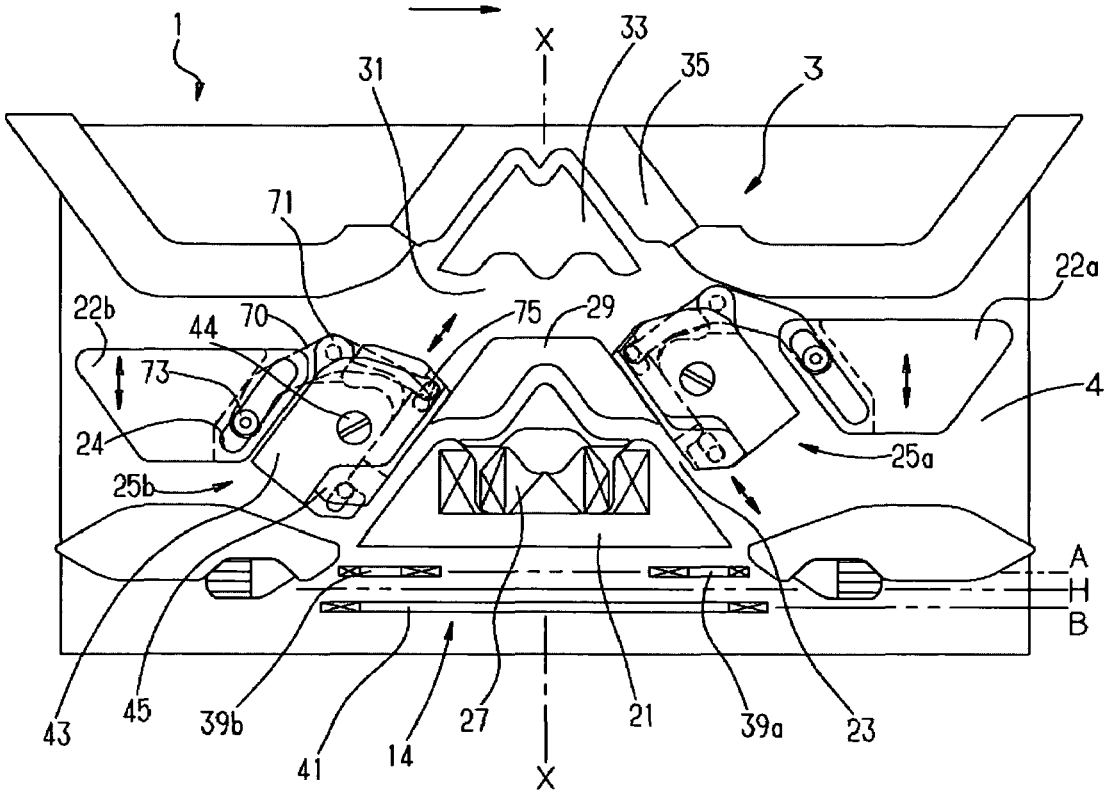
FIG. 1 illustrates a cam lock of a carriage as viewed from bottom.
Figure 2:
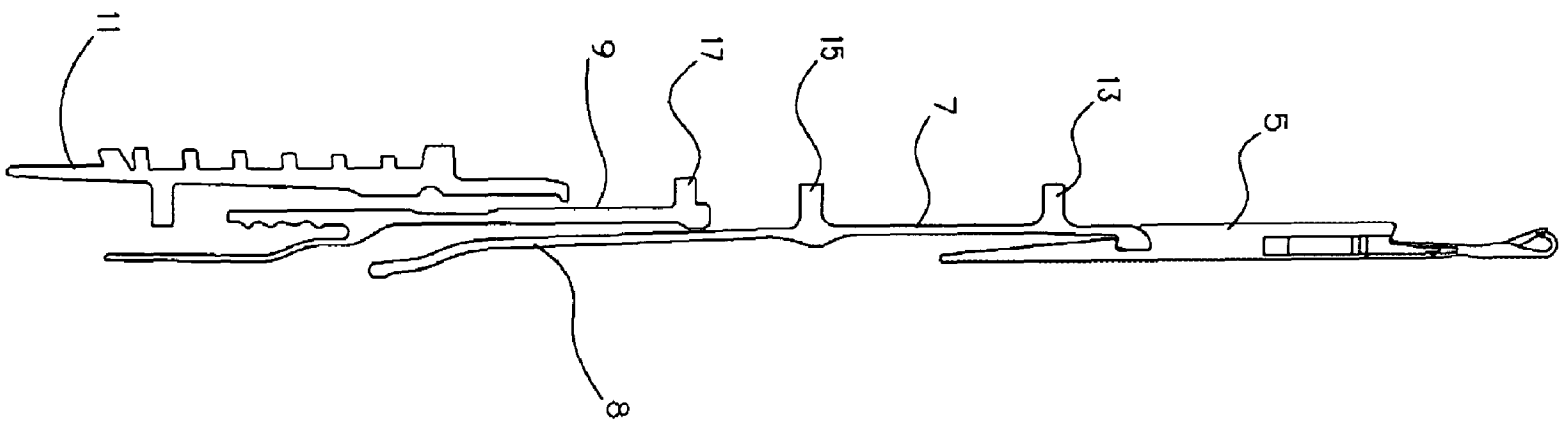
FIG. 2 is a side elevation view showing excerption of a combination of a needle fitted in a needle groove formed in a needle bed, a jack, a select jack, and a selector.

Now, certain preferred embodiments of a flat knitting machine having a variable stitch mechanism of the present invention will be described below with reference to the accompanying drawings. FIG. 1 illustrates a cam lock 3 of a carriage 1 as viewed from bottom, and FIG. 2 is a side elevation view showing excerption of a combination of a needle 5 fitted in a needle groove formed in a needle bed (not shown), a jack 7, a select jack 9, and a selector 11. The needle 5 is integrally connected with the jack 7 at a tail portion thereof. The needle 5 is operated to move back and forth by engagement of a first butt 13 and a second butt 15 of the jack 7, which are spaced from each other with respect to the longitudinal direction and projected from the jack 7, with a cam arranged in the cam lock 3.

An elastic leg 8 at the rear side of the jack 7 forces the select jack 9 to be biased upwardly so as to project a butt 17 of the select jack 9 together with a second butt 15. An upper position of the select jack 9 is limited to an upper limit by a wire (not shown) positioned above and extended in a longitudinal direction of the needle bed. When the butt 17 of the select jack 9 is pressed by a presser mounted on the carriage, the jack 7 positioned under the butt 17 is also subjected to the pressing action of the presser, so that the second butt 15 of the jack 7 is sunk into the needle groove. On the other hand, the first butt 13 provided near a joint portion thereof to the needle 5 is held in the position to project out from the needle groove, independently of the pressing action of the presser.

The cam lock is configured symmetrically with respect to a center line X. Stitch cams 25*a*, 25*b* are arranged in such a relation that a needle raising cam 21 and a passage 23 of the second butt 15 are sandwiched therebetween. The stitch cams 25*a*, 25*b* are structured to move back and forth in directions substantially parallel to inclined surfaces of the needle raising cam 21, respectively, by a drive mechanism (not shown). 27 designates a transfer receiving cam provided inside of the needle raising cam 21. A transfer cam is provided in front of a bridge cam 29 in such a relation that a passage 13 of the first butt 13 is sandwiched between the transfer cam and the bridge cam 29. 33 designates a retractable transfer cam, and 35 designates a transfer guide cam. The presser mechanism 14 for pressing the butt 17 of the select jack 9 is provided at a rear side of the needle raising cam 21. The select jack can be set at three different positions A, H, and B by controlling the forward and backward movement of the selector 11 by needle selection means (not shown). Second stitch pressers 39*a*, 39*b* are disposed at the position A. The second stitch pressers 39*a*, 39*b* act on the butt 17 of the select jack 9 set at the position A, so that the butt 17 is sunk half to be located at the level of the half height. A welt presser 41 is disposed at the position B to sink the butt 17 of the select jack 9 deep, so as to release the engagement between the second butt 15 and the cam. No presser is disposed at the position H. 70 designates linkages connected at front end thereof to the second cams of the stitch cams, as mentioned later. The linkages 70 are provided, at the other end thereof, with rollers 73, respectively. The rollers 73 are fitted in obliquely extending slots formed in the drive guide cams 22*a*, 22*b* driven back and forth by drive means, such as a step motor, disposed in an interior of the carriage.

Next, description will be given on a variable stitch mechanism of this embodiment with reference to FIGS. 3–5. As the stitch cams 25*a*, 25*b* disposed left and right in pairs have the same construction, reference is just made to one stitch cam 25*b*. The stitch cam 25*b* comprises a first cam 50, a second cam 80 and the linkage 70. The first cam 50 has a stitch size determining cam surface 61 engageable with the butt of full height 15 of the needle to form a larger stitch than a stitch formed with the needle of the butt of half height 15. On the other hand, the second cam 80 has a stitch size determining cam surface 89 engageable with the butt of half height 15 of the needle.

A slot extending in parallel with the inclined surface of the bridge cam 29 is formed in a cam plate 4 at a lower position of the first cam 50, though not shown. Also, a supporting block is slidably fitted in the slot and is connected to the drive mechanism arranged in the carriage. The first cam is cramped to the supporting block with a screw 44 extending through a cramping hole 46, so that when the supporting block is driven by the drive mechanism, the first cam is driven back and forth together with the supporting block.

The second cam 80 is supported to the first cam 50 in such a relation as to be shifted back and forth together with the first cam 50 by the drive mechanism of the first cam 50. Further, the second cam 80 is pivotally mounted on a pivot axis 57*a* on the first cam 50 and is connected to a separately arranged drive mechanism for the second cam (not shown) through the linkage 70 and a drive guide cam 22*b*, so that the second cam 80 is displaced relative to the first cam 50 by the drive of the drive mechanism. This can allow the second cam 80 to be adjusted to any selected position, and as such can allow a stitch size determining cam surface 89 to be displaced relative to the stitch size determining cam surface 61. The step difference between the stitch size determining cam surfaces can be adjusted within the range of e.g. 0.0 mm to 2.0 mm.

Figure 3:
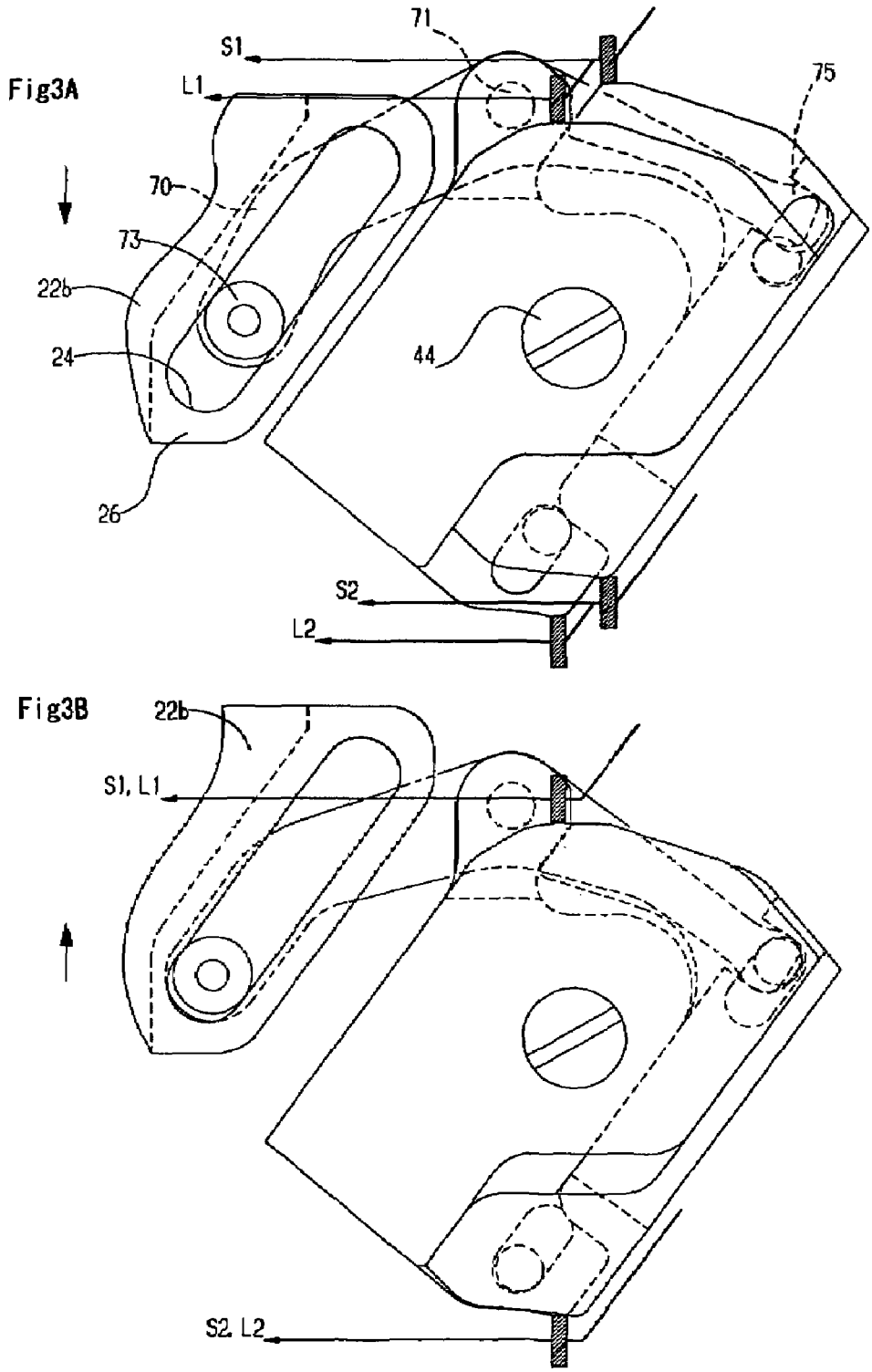
FIG. 3 is an enlarged view of a stitch cam.

FIG. 3 is an enlarged view of the stitch cam 25*b*. FIG. 3A illustrates the state in which the step difference of the second stitch is set to be large and FIG. 3B illustrates the state in which the step difference of the second stitch is set to be zero. FIG. 4 is a plan view showing main components of the stitch cam 25*b*. FIG. 5 shows side elevation views of the first cam and the second cam as viewed from the directions indicated by arrows of FIG. 4.

The first cam 50 has a full height portion 51 in its area except a part thereof in front and rear. The full height portion 51 has, on its right side, a guide surface 53 formed to give support to the sliding movement of the second cam 80 along the front-and-back direction. The guide surface 53 has, at the rear side thereof, a stop 55 formed to restrict a forward position of the second cam 80. The first cam has a projecting portion 57 formed with the level of the zero height to permit passage of the first butt 13. The projecting portion 57 is scraped at the back side thereof, from which the pivot axis 57*a*, disposed at a center portion of the linkage 70, to pivotally mount a rotation axis 71 thereon is projected downwardly. The full height portion 51 has a half height portion 56 formed at the rear side thereof. The half height portion 56 has, at a lateral side thereof, a retracting cam 59 engageable with the second butt of full height 15 and a stitch size determining cam surface 61 extending continuously therefrom. 67 designates a recess formed on a front side of the half height portion 56. The full-height portion 51 has, at a front edge thereof in the same phase as that of the stitch size determining cam surface 61, a receiving cam 63 engageable with the first butt 13. The back side of the full height portion 51 is cut off from front to right, to form a cutout 65, and an accommodating space to accommodate a portion 83 of the second cam is formed in a space defined between the cutout 65 and the cam plate 4. Reference numeral 69 designates a lug formed at the back side of the full height portion 51.

The second cam 80 has a full height portion 81 extending from right end to the rear end and a lower level portion 83 to be accommodated in the cutout 65 of the first cam 50. The full height portion 81 has, at the left side, a slidingly contacting surface 85 to contact with the guide surface 53 of the first cam 50. It has, at the right side, a common retracting face 87 engageable with both of the butt of full height and the butt of half height, to retract the needle. It also has, at a portion thereof extending continuously with the common retracting face 87, a stitch size determining surface 89 engageable with the butt of half height 15 only. The back side of the full height portion 81 is cut off at the rear side thereof, to form a cutout 93 to accommodate the half-height portion 56 of the first cam 50 therein. The full height portion 81 has, at a front edge thereof in the same phase as that of the stitch size determining cam surface 89, a receiving cam 95 engageable with the first butt 13 and an inclined surface 97 extending continuously from the receiving cam 95 rearwardly. A distance between the stitch size determining cam surface 61 and the receiving cam 63 of the first cam 50 and a distance between the stitch size determining cam surface 89 and the receiving cam 95 of the second cam 80 are both equal to a distance between the first butt 13 and the second butt 15 of the jack. This can provide the result that when a needle is operated to move back and forth to form a stitch, the second butt 15 of the needle is restricted in retraction by the engagement between the first butt 13 and the receiving cams 63, 95.

The second cam 80 has a recess 82 formed by cutting off the back side of the low level portion 83, and a front end 75 of the linkage 70 is inserted in the recess 82. A roller 73 is pivoted at the rear end of the linkage 70 and is fitted in the slot 24 formed in the drive guide cam 22*b* immediately near the stitch cam 25*b* and extending in parallel with the sliding direction of the stitch cam. The drive guide cam 22*b* is formed by a cam having the zero height to allow the passage of the first butt 13. The drive guide cam 22*b* is connected at the back side thereof with a drive mechanism, such as a stepping motor, not shown, directly or indirectly so that it can be slid back and forth over the cam plate. When the drive guide cam 22*b* is driven back and forth by the drive means, the roller 73 in the slot is also driven back and forth, so that the linkage 70 is pivoted around the rotation axis 71. Along with this pivotal movement of the linkage 70, the stitch size determining cam surface 89 of the second cam is displaced relative to the stitch size determining cam surface 61 of the first cam. This can allow the adjustment of a relative position of the stitch size determining cam surface 89 of the second cam in the back-and-forth direction with respect to the stitch size determining cam surface 61 of the first cam, i.e., the step difference therebetween. After the step difference between the stitch size determining cam surfaces of the first and second cams is set by the drive means of the second cam, the second cam is driven back and forth together with the first cam by the drive means of the first cam. At this time, the second cam can be displaced freely without being subjected to any restraining action of the driving means of the second cam, because the slot 24 of the drive guide cam 22*b* is extended in the same direction as the sliding direction of the stitch cam. This can permit the adjustment of the forward position of the stitch cam to form any desired sized stitch, while the step difference between the stitch size determining cams as was set is kept unchanged. It is needless to say that the step difference can also be adjusted on a case-by-case basis by driving the drive means of the second cam.

In the embodiment illustrated above, the slot extending in parallel with the sliding direction of the stitch cam is provided in the form of the drive guide in the drive guide cam and the roller of the linkage is fitted in that slot, whereby the second cam is driven back and forth together with the first cam, and also the stitch size determining cam surface of the second cam is driven back and forth by the drive means of the second cam, whereby the stitch size determining cam surface of the second cam is displaced with respect to the stitch size determining cam surface of the first cam. As long as the substantially same motion of the second cam can be allowed, any construction can be used without being limited to the construction outlined above. For example, the drive guide cam may be driven laterally or in a left-and-right direction, rather than in the back-and-forth direction. Also, instead of the construction of the slot, projections extending in parallel with the sliding direction of the stitch cam may be provided in the drive guide cam and a pair of rollers to hold the linkage in a sandwich relation therebetween may be provided in the linkage.

The first cam 50 and the second cam 80 are combined in a laminated form having a structure to allow the interchange of the positional relation therebetween so that when they are positioned at the fore end closer to the needle bed gap, the first cam 50 is located higher in level (on the front side) than the second cam 80, while on the other hand, when they are positioned at the rear end, the first cam 50 is located lower in level than the second cam 80. The second cam is supported on the guide surface 53 of the first cam 53 and also the recess 67 and the lug 69 formed in the first cam and a lug 99 and a recess 88 formed in the second cam are combined with each other. This can allow the second cam to be reliably guided in the sliding direction by the first cam. Accordingly, the second cam 80 can be prevented being dropped out from the first cam by simply cramping the first cam 5 to the supporting block with the screw.

Now, operation of the stitch cam thus constructed in the process of the second stitch knitting will be described.

Suppose that the carriage 1 is traveling rightwards as viewed from a plane of paper of FIG. 1, for the knitting. The butt 17 of the select jack of the small stitch forming needle is set at the position A of FIG. 1 and the butt 17 of the select jack of the large stitch forming needle is set at the position H of FIG. 1 by known election means, not shown. No presser is set at the position H, and the second stitch presser 39*a* on the trailing side is set at the position A.

The small stitch forming needle is brought into contact with the inclined surface of the needle raising cam 21 and is moved forward to the top of the cam, while being kept at the level of the full height together with the second butt 15 of the large stitch forming needle, until it is subjected to the pressing action of the presser 39*b*. Thereafter, it is retracted by the bridge cam 29. Then, after a knitting yarn is fed to a hook of the needle 5 by yarn feeding means, not shown, the second butt 15 of the jack 7 is engaged with the common retracting cam surface 87 formed on the second cam 80 of the stitch cam 25*b* on the trailing side and is pulled.

At this position, the second butt 15 of the jack of the small stitch forming needle is subjected to the pressing action of the second stitch presser 39*a* and thus sunk generally half, so that the second butt 15 of the jack 7 is located at the level of the half height thereat. On the other hand, since no presser is provided at the position H, the second butt 15 of the large stitch forming needle is kept at the level of the full height thereat. Subsequently, the second butt of the small stitch forming needle and the second butt of the large stitch forming needle are both subjected to the action of the stitch cam, while they are kept at their respective heights.

FIG. 3A shows paths of the first butt and the second butt of the large stitch forming needle and paths of the first butt and the second butt of the small stitch forming needle. The path of the first butt of the large stitch forming needle is designated by L1 and the path of the second butt of the same is designated by L2. The path of the first butt of the small stitch forming needle is designated by S1 and the path of the second butt of the same is designated by S2. As seen from the drawing figure, when the large stitch forming needle reaches a terminal end of the common retracting cam surface 87 of the second cam 80, the second butt 15 of full height is moved just slightly along the stitch size determining cam surface 89 formed on the second cam at the moment. Then, it is engaged with the retracting cam 59 formed in the first cam and then is retracted further. Then, it passes along the stitch size determining cam surface 61. At this time, the first butt 13 of the large stitch forming needle passes along the receiving cam 95 of the second cam and then passes along the inclined surface 97 and, thereafter, it is guided to the receiving cam 63 of the first cam and passes therealong. This can prevent the second butt 15 from being retracted excessively beyond the stitch size determining cam surface 61.

On the other hand, the second butt 15 of the small stitch forming needle is located at the level of half height and, accordingly, it passes along the stitch size determining cam surface 89 formed in the second cam, without being subjected to the action of the retracting cam 59 of the first cam. At this time, the first butt 13 is received by the receiving cam 95 of the second cam, so that the second butt 15 is prevented from being retracted excessively beyond the stitch size determining cam surface 89. Thus, the small stitch forming needle and the large stitch forming needle can form the stitches of different in size corresponding to the step difference between the stitch size determining cam surfaces 89, 61, respectively. Further, since the second cam is constructed to be movable back and force in the same direction as the driving direction of the first cam, the orientations of the respective stitch size determining cam surfaces can be fixed invariably, avoiding the problem of inconformity in orientation between the respective stitch size determining cam surfaces caused by the rock position and the resulting angle therebetween, as involved in the conventional rocking type one as previously outlined. This is desirable for the stitch formation.

(Second Embodiment)

Figure 6:
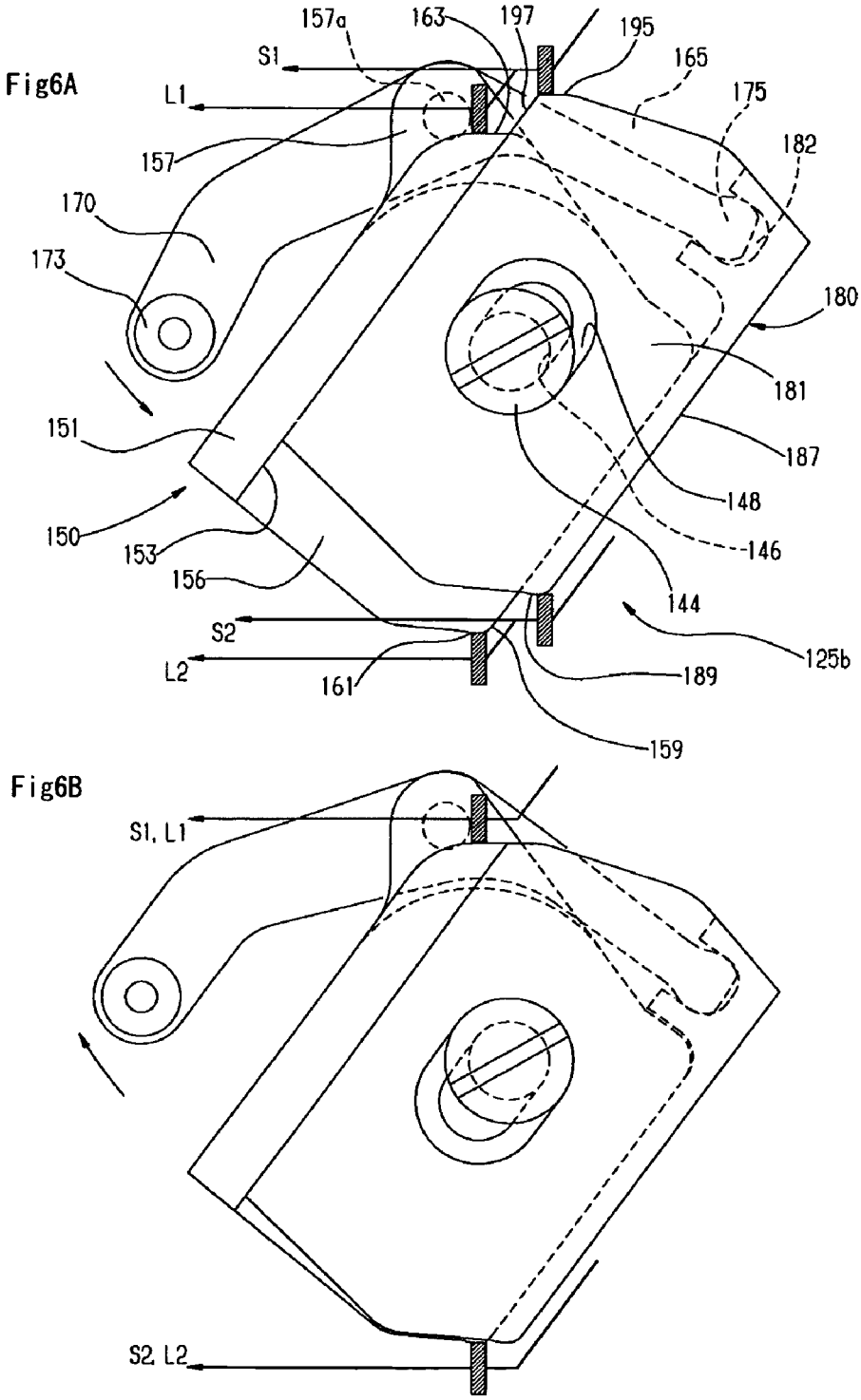
FIG. 6 shows a stitch cam according to the second embodiment.

Referring to FIG. 6, there is shown a stitch cam of the second embodiment. The stitch cam 125*b* comprises a first cam having a stitch size determining cam surface 161 of the second butt of full height and a receiving portion 163 of the first butt, both being arranged in the same phase, and a second cam slidingly supported at a higher level than the first stitch cam and having a stitch size determining cam surface of the second butt of half height and a receiving portion of the first butt, both being arranged in the same phase. The second cam is shifted toward the leading side and mounted so that stitch size determining cam surface and the receiving cam of the second cam are positioned closer to the leading side than the stitch size determining cam surface and the receiving cam of the first cam. The first cam and the second cam have substantially the same outer shape. In this drawing figure, corresponding parts to those of the first embodiment are designated by reference numerals of three digits whose unit and tenth digits are the same and hundredth digit is 100. Take for instance, the common stitch size determining cam surface designated by 87 in the first embodiment is designated by 187 in the second embodiment.

The first cam 150 has a full height portion 151 and a half height portion 156. A step is formed at the boundary between these portions, which forms a guide surface 153 for supporting a second cam 180 slidingly in the front-and-back direction. 157 designates a projecting portion formed in a front portion of the first cam. The projecting portion 157 has a pivot axis 157*a* for pivotally mounting thereon a rotation axis of a linkage 170. 173 designates a roller. The linkage 170 is supported in the same manner as in the first embodiment. The half height portion 156 has, at a portion thereof extending from the right side to the rear side, a retracting cam 159 and a stitch size determining cam surface 161 extending continuously therefrom, both being engageable with the butt of full height 15. The full height portion 151 has a receiving cam 163 which is formed at a front edge thereof in the same phase as the stitch size determining cam surface 161, to engage with the first butt 13.

The second cam 180 is supported on the half height portion 156 of the first cam 150 and has the full height in its entirety. It has a common retracting cam surface 187 to retract the needle of the butt of full height 15 and the needle of the butt of half height 15 and a stitch size determining cam surface 189 which are formed along an inclined surface thereof confronting the bridge cam. It also has a receiving cam 195 and an inclined surface 197 extending continuously therefrom, both being formed at a front edge thereof in the same phase as the stitch size determining cam surface 189 to engage with the first butt 13.

Also, the second cam 180 has a slot 148 at a center portion thereof and is slidingly mounted on the first cam via a shouldered screw 144 thereat. In this embodiment, not only the first cam but also the second cam are fixed to the supporting block slidingly arranged in the slit by the shouldered screw 144. 146 designates a mounting hole formed in the first cam. The second cam 180 projects downwardly at a right end thereof, at which a receiving portion 182 to receive a front end 175 of the linkage is formed so that the second cam 180 can be displaced relative to the first cam 151 by the turning of the linkage. The turning of the linkage is performed by the drive guide cam being shifted in the front-and-back direction by the drive means in the same manner as in the above, though not shown in FIG. 6. Reference characters S1, S2, L1, and L2 in the drawing figure designate the paths of the butt of full heights and the paths of the first and second butts 13, 15 of half height, which correspond to the paths which the respective butts of the first embodiment take. This embodiment can provide the advantage of providing further simplified structure of the stitch cam, as compared with the previous embodiment.

(Third Embodiment)

Referring now to FIGS. 7–9, there is shown the stitch cam for the second stitch of the third embodiment. FIG. 8 merely shows the first and second cams from which the linkage is removed. In the stitch cam of this embodiment, a receiving cam for preventing the butt from being retracted excessively is arranged at a location on the side on which the second butt of the jack in the previous embodiment is set and across which the stitch size determining cam surface and the butt's path are arranged. This can allow the application of the stitch cam to a knitting needle designed to be driven back and forth via a single butt. In the drawing figures, corresponding parts to those of the first embodiment are designated by reference numerals of three digits whose unit and tenth digits are the same and hundredth digit is 200.

This embodiment has substantially the same supporting structure for the second cam to be supported on the cam plate as the supporting structure of the first embodiment. Specifically, a first cam 250 and a second cam 280 are combined in a laminated form having the structure to allow the interchange of the positional relation therebetween in the middle of the front-and-back direction. This can allow the relative movement of the second cam 280 to the first cam 250 to be guided by the first cam 250. The second cam 280 is prevented being dropped out from the first cam 250 by cramping the first cam 250 to the supporting block with a screw 244.

Referring to the first cam 250, reference numeral 251 designates a full height portion formed in its area except a part thereof in front and rear. 255 designates a guide surface to give support to the sliding movement of the second cam 280 in the front-and-back direction. 255 designates a stop of the second cam 280. 257 designates a projecting portion formed with the level of the zero height. 257*a* designates a pivot axis for the linkage 270 projecting from the back side thereof. 256 designates a half height portion where a retracting cam 259 engageable with the butt of full height 15 and a stitch size determining cam surface 261 are formed. 267 designates a recess, which forms a slide guide of the second cam 280, together with a lug 269 formed at the back side of the full height portion 251. The full height portion 251 of the first cam 250 has a receiving portion 301 extended at the rear side thereof and also has a half height portion 303 across the butt's path. The half height portion 303 has, at its portion confronting the stitch size determining cam surface 261, a receiving cam 305 for preventing the excessive retraction of the butt. A portion 307 is formed with the level of zero height to permit passage of the butt. The half height portion 303 may be in the form of the full height portion for arranging the receiving cam. The full height portion 251 has cutouts 265, 266 formed in the back side thereof. A space between the cutout 265 and the cam plate provides an accommodating space for a portion 283 of the second cam 280, and an accommodating space for accommodating the linkage 270 is provided under the cutout 266.

Referring now to the second cam 280, reference numeral 281 designates a full height portion. 283 designates a lower level portion to be accommodated in the cutout 265 of the first cam 250. 285 designates a slidingly contacting surface to contact with the guide surface 253 of the first cam 250. 287 designates a common retracting surface to retract the needle of the butt of full height and the needle of the butt of half height. 289 designates a stitch size determining surface for forming a small stitch. The full height portion 281 has, at a back side thereof, a cutout to accommodate the portion 256 of the first cam. Also, there is provided a receiving portion 331 extending rearwardly of the stitch size determining cam surface 289, and a full height portion 333 has a receiving cam 335 to engage with each of the butt of half height and the butt of full height so as to prevent the needle from being retracted excessively. 339 designates an inclined surface formed at the trailing side of the receiving cam 335. A portion 337 is formed with a height to allow the passage of the butt, as is the case with the portion 303.

The stitch cam 250 of this embodiment is designed so that the step difference of the stitch size determining cam surface 289 of the second cam from the stitch size determining cam surface 289 of the second cam is adjusted by pivoting the linkage 270 about the pivot axis 257*a*, as in the case of the above-said embodiments. FIG. 7A shows the state in which the step difference is set at the maximum, and FIG. 7B shows the state in which the step difference is set at zero. The respective receiving cams 305, 335 are formed so that they can be aligned with each other in the state of FIG. 7B.

The invention claimed is:

1. A knitting machine having a variable stitch mechanism comprising a stitch cam, said stitch mechanism comprising:

a common retracting cam surface to engage with at least one of butts projecting from a needle bed and set at different levels of full height and half height under a pressing action of a presser arranged in a carriage, so as to retract both a butt of half height of a small stitch forming needle and a butt of full height of a large stitch forming needle, a stitch size determining cam surface for a small-sized stitch which is formed to extend continuously from the common retracting cam surface, a stitch size determining cam surface for a large-sized stitch which is engageable with the butt of full height formed at a trailing side with respect to the stitch size determining cam surface for the small-sized stitch, and a receiving cam to restrict excessive retraction of each of the butts of the different-sized stitches forming needles beyond the stitch size determining cam surface corresponding to the butt of the stitch forming needle, whereby the small-sized stitch and the large-sized stitch are formed in the same course;

wherein said stitch cam comprising:

a first cam in which a stitch size determining cam surface for a large-sized stitch and a receiving cam surface to engage with a butt of the needle for forming the large-sized stitch are formed in the same phase as the stitch size determining cam surface, and a second cam having a common retracting cam surface and a stitch size determining cam surface for a small-sized stitch extending continuously from the common retracting cam surface, wherein a receiving cam surface engageable with a butt of the needle for forming the small-sized stitch is formed in the same phase as the stitch size determining cam surface for the small-sized stitch, drive means for driving the first cam in a front-and-back direction, and drive means for driving the second cam in the front-and-back direction, and wherein the second cam is supported on the first cam in such a manner that when the first cam is shifted in the front-and-back direction by the drive means of the first cam, the second cam is shifted together in the front-and-back direction and also shifted relative thereto in the front-and-back direction by the drive means of the second cam so that the stitch size determining cam surface provided in the second cam can be displaced with respect to the stitch size determining cam surface provided in the first cam.

2. The knitting machine according to claim 1, wherein a linkage is pivotally mounted on the first cam and linked at one end thereof to the drive side and at the other end to the second cam, so that when the linkage is rotated by the drive of the drive means of the second cam, the second cam is driven to adjust a position of the stitch size determining cam surface of the second cam relative to the stitch size determining cam surface of the first cam.

3. The knitting machine according to claim 2, wherein a drive guide cam which is driven in the front-and-back direction or a left-and-right direction by the drive means of the second cam is arranged between the drive means of the second cam and the linkage, a drive guide extending in parallel with a sliding direction of the stitch cam is formed in the drive guide cam, and a driving side of the linkage is supported to freely move along the drive guide.

4. The knitting machine according to claim 2, wherein the receiving cam surfaces are formed at front sides of the first and second cams and in the same phase as the respective stitch size determining cam surfaces, and wherein another butt, which is engageable with these receiving cams and is arranged so that a distance between the butt and the another butt can be equal to a distance between the stitch size determining cam surfaces and the receiving cam surfaces, is formed in the needle.

5. The knitting machine according to claim 2, wherein the receiving cam surfaces are arranged at the rear side of the first and second cams to confront the stitch size determining cam surfaces across path regions of the butts.

* * * * *